US008052262B2

(12) United States Patent
Tokuno et al.

(10) Patent No.: US 8,052,262 B2
(45) Date of Patent: Nov. 8, 2011

(54) LIQUID CONTAINER AND IMAGE FORMING APPARATUS EMPLOYING THE LIQUID CONTAINER

(75) Inventors: Toshiroh Tokuno, Machida (JP); Tomomi Katoh, Ebina (JP); Shotaro Takeuchi, Atsugi (JP); Akiko Bannai, Atsugi (JP); Masanori Kusunoki, Tokyo (JP); Masahiro Kuwata, Atsugi (JP); Tadashi Hayakawa, Yokohama (JP); Ikoh Soh, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/722,138

(22) Filed: Mar. 11, 2010

(65) Prior Publication Data

US 2010/0232827 A1 Sep. 16, 2010

(30) Foreign Application Priority Data

Mar. 12, 2009 (JP) ..... 2009-058996
Jan. 20, 2010 (JP) ..... 2010-010432

(51) Int. Cl.
*B41J 2/175* (2006.01)

(52) U.S. Cl. ..... 347/86

(58) Field of Classification Search ..... 347/7, 84, 347/86

See application file for complete search history.

(56) References Cited

U.S. PATENT DOCUMENTS

| | | | | |
|---|---|---|---|---|
| 4,557,151 | A * | 12/1985 | Welker | 73/863.84 |
| 6,629,758 | B2 * | 10/2003 | Okamoto et al. | 347/85 |
| 6,692,118 | B2 * | 2/2004 | Michele et al. | 347/86 |
| 6,695,443 | B2 | 2/2004 | Arita et al. | |
| 7,325,908 | B2 | 2/2008 | Katoh et al. | |
| 7,540,598 | B2 | 6/2009 | Hori et al. | |
| 2008/0231653 | A1 | 9/2008 | Kawashima et al. | |
| 2009/0013779 | A1 * | 1/2009 | Usui et al. | 73/290 V |
| 2009/0051724 | A1 | 2/2009 | Katoh | |
| 2009/0256892 | A1 | 10/2009 | Takeuchi | |
| 2009/0290002 | A1 | 11/2009 | Katoh | |
| 2010/0020142 | A1 | 1/2010 | Bannai et al. | |

FOREIGN PATENT DOCUMENTS

| | | |
|---|---|---|
| JP | 10-329329 | 12/1998 |
| JP | 2004-50709 | 2/2004 |
| JP | 2004-276538 | 10/2004 |
| JP | 2004-284093 | 10/2004 |
| JP | 2004-284094 | 10/2004 |
| JP | 3919734 | 2/2007 |
| JP | 2008-49640 | 3/2008 |
| JP | 2008-162215 | 7/2008 |

* cited by examiner

*Primary Examiner* — Stephen Meier
*Assistant Examiner* — Tracey McMillion
(74) *Attorney, Agent, or Firm* — Cooper & Dunham LLP

(57) ABSTRACT

A liquid container is detachably mountable in an image forming apparatus having a liquid introducing member. The liquid container includes a storage unit, a supply port assembly, and an elastic seal member. The storage unit is disposed in the liquid container to store a liquid usable for image formation. The supply port assembly is mounted in the storage unit and has a supply channel therein. The liquid introducing member of the image forming apparatus is inserted into the supply port assembly. The elastic seal member is disposed in the supply port assembly. When penetrated by the liquid introducing member, the elastic seal member moves together with the liquid introducing member relative to the supply port assembly to open and close the supply channel.

14 Claims, 20 Drawing Sheets

LIQUID CONTAINER AND IMAGE FORMING APPARATUS EMPLOYING THE LIQUID CONTAINER

CROSS-REFERENCE TO RELATED APPLICATIONS

The present patent application claims priority pursuant to 35 U.S.C. §119 from Japanese Patent Application Nos. 2009-058996, filed on Mar. 12, 2009 and 2010-010432, filed on Jan. 20, 2010 in the Japan Patent Office, each of which is incorporated herein by reference in its entirety.

BACKGROUND

1. Technical Field

Illustrative embodiments of this disclosure relate to a liquid container and an image forming apparatus employing the liquid container.

2. Description of the Background

Image forming apparatuses are used as printers, facsimile machines, copiers, plotters, or multi-functional peripherals having two or more of the foregoing capabilities. As one type of image forming apparatus employing a liquid-ejection recording method, an inkjet recording apparatus is known that ejects liquid droplets from a recording head. Another type of image forming apparatus is also known that forms images using an electrophotographic method.

Image forming apparatuses employing the liquid-ejection recording method ejects ink droplets from the recording head onto a recording material to form an image on the recording material. Such liquid-ejection-type image forming apparatuses fall into two main types: a serial-type image forming apparatus that forms an image by ejecting droplets while moving a recording head in a main scan direction, and a line-head-type image forming apparatus that forms an image by ejecting droplets from a linear recording head fixedly disposed in the image forming apparatus.

In a liquid-ejection-type image forming apparatus, both the recording head and a sub tank (also known as a buffer tank or head tank) may be mounted on a carriage. In such a case, a main ink cartridge (main tank) is detachably mounted in the image forming apparatus to supply ink to the sub tank.

Such an ink cartridge may consist of a divisible cartridge case that houses an ink-containing pack in which a holder with ink supply and refill ports is fused to a pack body. An elastic member is disposed within the ink supply port. A hollow needle provided in the image forming apparatus is inserted through the elastic member, connecting a hole (ink inlet) in the tip of the needle to an ink channel to supply ink to the ink-containing pack.

A problem with the above-described conventional ink cartridge is that ink may leak when the hollow needle is inserted to or extracted from the elastic member in the ink supply port in the holder of the ink-containing pack.

BRIEF SUMMARY

In an illustrative embodiment of this disclosure, a liquid container is detachably mountable in an image forming apparatus having a liquid introducing member. The liquid container includes a storage unit, a supply port assembly, and an elastic seal member. The storage unit is disposed in the liquid container to store a liquid usable for image formation. The supply port assembly is mounted in the storage unit and has a supply channel therein. The liquid introducing member of the image forming apparatus is inserted into the supply port assembly. The elastic seal member is disposed in the supply port assembly. When penetrated by the liquid introducing member, the elastic seal member moves together with the liquid introducing member relative to the supply port assembly to open and close the supply channel.

In another illustrative embodiment, an image forming apparatus includes a liquid introducing member, a protective member, a bias member, and a liquid container. The liquid introducing member has an inlet port in a front end portion thereof to introduce liquid from the inlet port. The protective member is movably mounted on the front end portion of the liquid introducing member to cover the inlet port of the liquid introducing member. The bias member is disposed at a rear side of the protective member and biases the protective member toward a front side of the protective member. The liquid container is detachably mounted in the image forming apparatus. The liquid container includes a storage unit, a supply port assembly, and an elastic seal member. The storage unit is disposed in the liquid container to store a liquid usable for image formation. The supply port assembly is mounted in the storage unit and has a supply channel therein. The liquid introducing member of the image forming apparatus is inserted into the supply port assembly. The elastic seal member is disposed in the supply port assembly. When penetrated by the liquid introducing member, the elastic seal member moves together with the liquid introducing member relative to the supply port assembly to open and close the supply channel. The liquid introducing member is inserted into the supply port assembly with the protective member fitted to a front end portion of the supply port assembly by the bias member in installation of the liquid container to the image forming apparatus. The liquid introducing member is extracted from the supply port assembly and retracted into the protective member with the protective member fitted to the front end portion of the supply port assembly by the bias member in detachment of the liquid container from the image forming apparatus.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
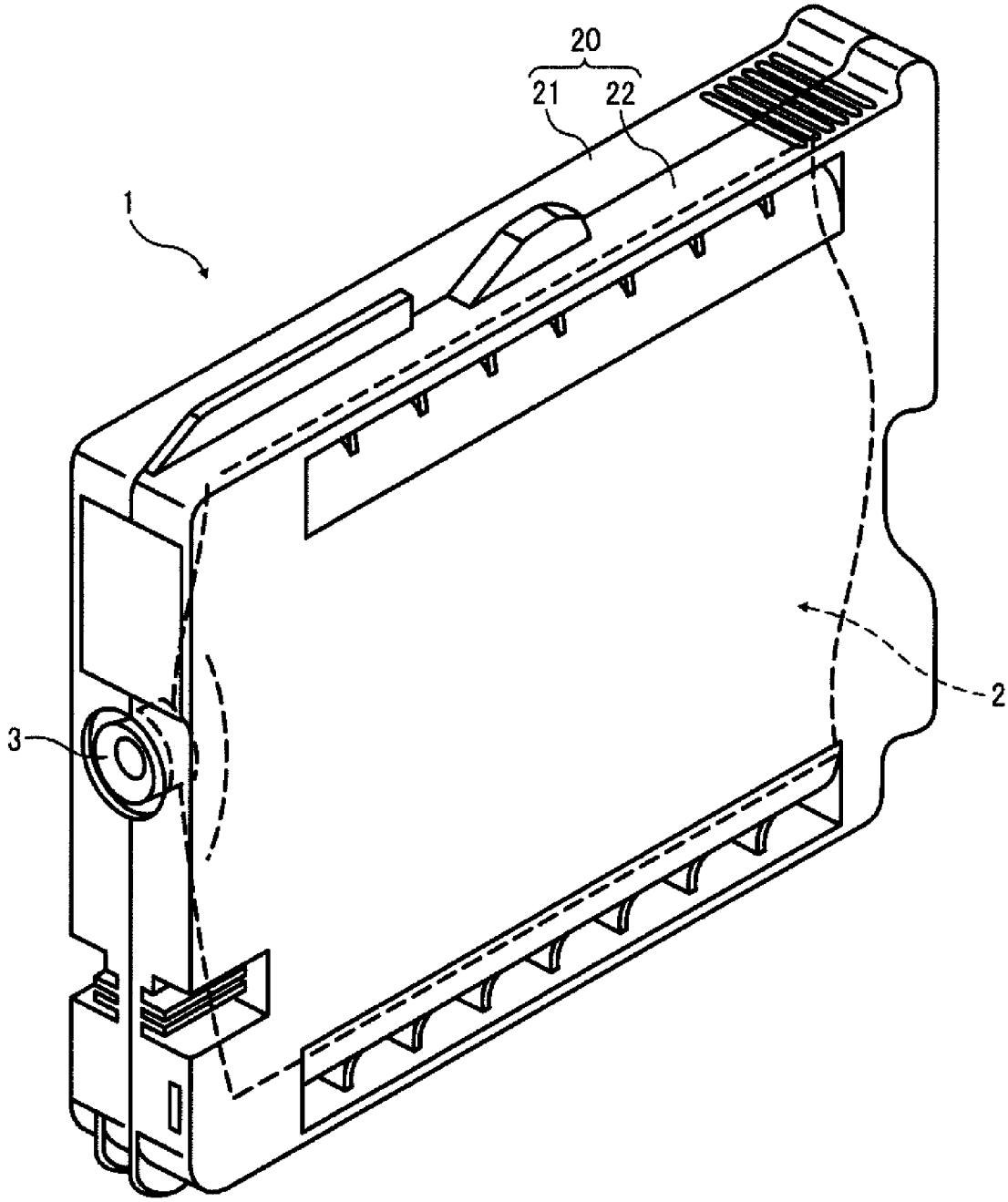
FIG. 1 is a perspective view illustrating a configuration of an ink cartridge that is a liquid container according to a first illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "sheet" used herein is not limited to a sheet of paper and may be an OHP (overhead projector) sheet or any other material on which ink or other liquid is adhered. The term "sheet" may be referred to as a medium, a recording medium, a recorded medium, a sheet material, a transfer material, a recording sheet, a sheet of paper, or the like. The term "image formation" is used herein as a synonymous of recording, printing, or imaging.

Further, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation" used herein includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present disclosure are described with reference to attached drawings.

Figure 2:
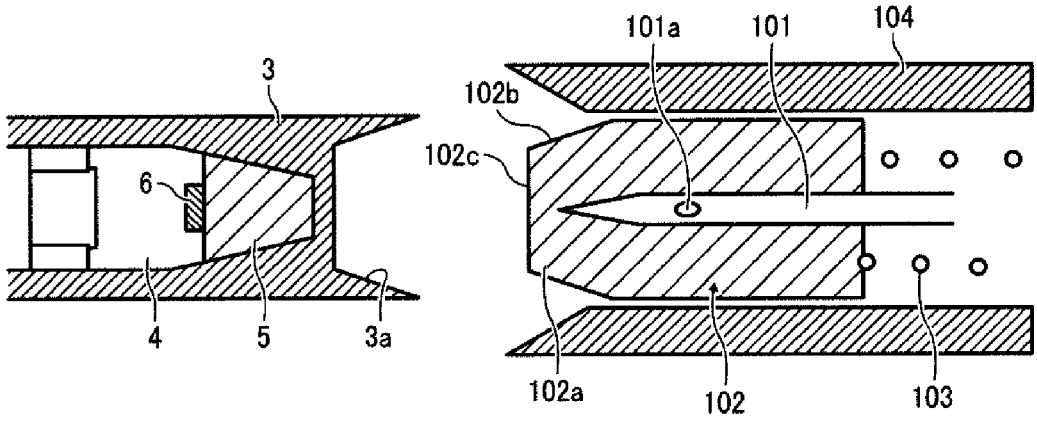
FIG. 2 is a cross-sectional view illustrating a coupling unit between the ink cartridge and an image forming apparatus.

A liquid container according to a first illustrative embodiment is described with reference to FIGS. 1 and 2. FIG. 1 is a perspective view illustrating a configuration of an ink cartridge 1 serving as the liquid container. FIG. 2 is a cross-sectional view illustrating the ink cartridge 1, a supply port assembly 3, and a coupling unit between the ink cartridge 1 and an image forming apparatus.

The ink cartridge 1 serving as the liquid container includes an ink pack 2, a supply port assembly 3, and a cartridge case 20. The ink pack 2 is a storage unit that stores ink or any other liquid useable for image formation. The supply port assembly 3 is mounted on the ink pack 2, and a hollow needle 101 serving as a liquid introducing member disposed in the image forming apparatus is inserted to the supply port assembly 3. The ink pack 2 is housed in the cartridge case 20 consisting of two case pieces 21 and 22.

The supply port assembly 3 includes a supply channel 4 and a seal member 5 made of an elastic material. As illustrated in FIG. 2, when the hollow needle 101 is inserted from the image forming apparatus to the supply port assembly 3, the seal member 5 moves together with the hollow needle 101 relative to the supply port assembly 3 to open/close the supply channel 4.

The ink pack 2 is formed of a flexible film member. For example, the flexible film member may be made of a single type of resin material or a plurality of types of resin materials with a layered structure. Alternatively, the flexible film member may have a metal thin-film layer as a surface layer or an intermediate layer of the layered structure. For the resin composition, a film of olefin resin composition, e.g., a polyethylene film may be preferable with respect to the liquid-contact properties with ink. The metal thin-film layer may be a layer, such as an aluminum thin layer, capable of reducing the moisture permeability of the film and/or enhancing the stiffness of the film.

Figure 3:
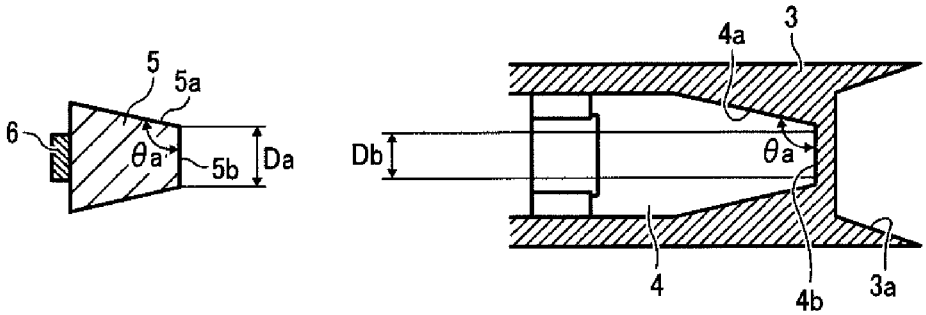
FIG. 3 is a cross-sectional view illustrating a supply port assembly of the ink cartridge.

At an outer surface of a front end portion of the supply port assembly 3 is formed a recessed portion 3*a* having a conical trapezoidal shape. The recessed portion 3*a* fits a protective member 102 covering an outer circumference of a hollow-needle hole 101*a* that is an ink inlet port of the hollow needle 101 of the image forming apparatus. In the supply port assembly 3, the supply channel 4 is formed in communication with the interior of the ink pack 2. As illustrated in FIG. 3, the supply channel 4 has a fit portion that fits the seal member 5. The supply channel 4 has a conical trapezoidal shape, specifically, a trapezoidal shape at a cross section in which the fit portion of the supply channel 4 has a tapered face 4*a* that tapers toward the front end of the supply port assembly 3. The "front end" of the supply port assembly 3 (the ink cartridge 1) used herein refers to an end of the supply port assembly 3 close to the image forming apparatus when the ink cartridge 1 is installed to the image forming apparatus.

The seal member 5 is made of an elastic material, e.g., silicone rubber, fluorocarbon rubber, Butyl rubber, or EPDM (Ethylene Propylene Diene Monomer) rubber and has a conical trapezoidal shape, specifically, a trapezoidal shape at a cross section in which the seal member 5 has a tapered face 5*a* that fits the tapered face 4*a* of the supply channel 4.

The relation between a diameter (or area) Da of a top face 5*b* of the seal member 5 and a diameter (or area) Db of a front end face 4*b* of the supply channel 4 or the relation between an angle θa of the tapered face 5*a* relative to the top face 5*b* of the seal member 5 and an angle θb of the tapered face 4*a* relative to the front end face 4*b* of the supply channel 4 preferably meets a relation in which, when the supply channel 4 is closed by the seal member 5, the front end face 4*b* closely fits the top face 5*b* so that sealing is formed from the top faces of the tapered faces 4*a* and 5*a* including a generating line. For such a relation, when the supply channel 4 is closed by the seal member 5, ink escapes inward, i.e., toward the rear end of the seal member 5, thus securely sealing without sandwiching ink.

On the rear end face of the seal member 5 is fixed a hard member 6, such as a metal plate, which is a stopper not pierced by the hollow needle 101. In such a configuration, when the hollow needle 101 is inserted to the seal member 5, the hard member 6 stops the hollow needle 101 and then the hard member 6 moves together with the hollow needle 101 (and the seal member 5 starts to detach from the front end portion of the supply channel 4).

Meanwhile, the hollow needle 101 in the image forming apparatus is connected to a pump, not illustrated, and the pump suctions ink from the ink cartridge 1 and feeds ink to a liquid ejection head. When the ink cartridge 1 is not mounted in the image forming apparatus, the hollow-needle hole 101*a*, which is the inlet port of the hollow needle 101, is held in the protective member 102 made of an elastic member to prevent drying and assure safety.

The protective member 102 is movably mounted on the hollow needle 101, and a spring 103 is provided between the protective member 102 and a fix portion, not illustrated. At the front end portion of the protective member 102, a fit portion 102*a* of a conical trapezoidal shape is formed with a tapered face 102*b* and a flat face 102*c* to fit a recessed portion 3*a* of a conical trapezoidal shape at the front end portion of the supply port assembly 3. The shapes of the fit portion 102*a* of the protective member 102 and the recessed portion 3*a* of the supply port assembly 3 are formed similar to the shapes of the seal member 5 and the fit portion of the supply channel 4. The term "front end" of the protective member 102 of the image forming apparatus refers to an end of the protective member 102 close to the ink cartridge 1.

At the exterior of the protective member 102 is disposed a hollow guide member 104.

Next, installation/detachment of the ink cartridge 1 to/from the image forming apparatus is described with reference to FIGS. 4 and 5.

Figure 4A:
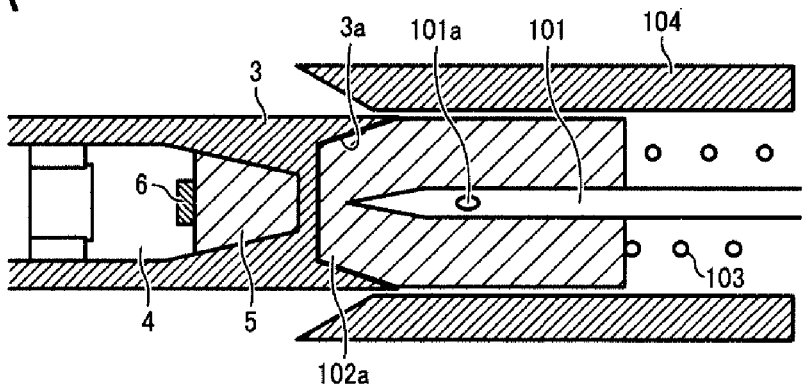
FIGS. 4A to 4C are cross-sectional views illustrating operations of the coupling unit upon installation/detachment of the ink cartridge to/from the image forming apparatus.
Figure 5:
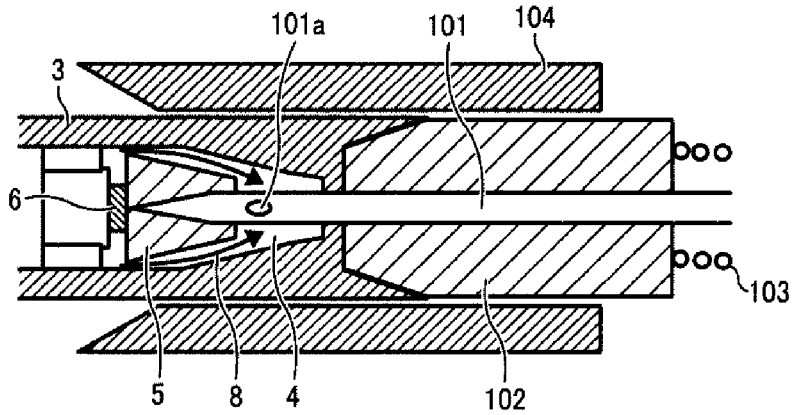
FIG. 5 is a cross-sectional view illustrating a state of the ink cartridge mounted in the image forming apparatus.

By inserting the ink cartridge 1 into a cartridge mount portion of the image forming apparatus, as illustrated in FIG. 4A, the recessed portion 3*a* of the front end portion of the supply port assembly 3 of the ink cartridge 1 fits the fit portion 102*a* of the protective member 102 disposed in the image forming apparatus, and both the tapered face 102*b* and the flat face 102*c* of the protective member 102 closely fit the recessed portion 3*a*. At this state, the seal member 5 in the supply port assembly 3 of the ink cartridge 1 remains fitted to the inner wall surface of the supply channel 4, and the supply port assembly 3 is sealed from both the inside and outside thereof.

Figure 4B:
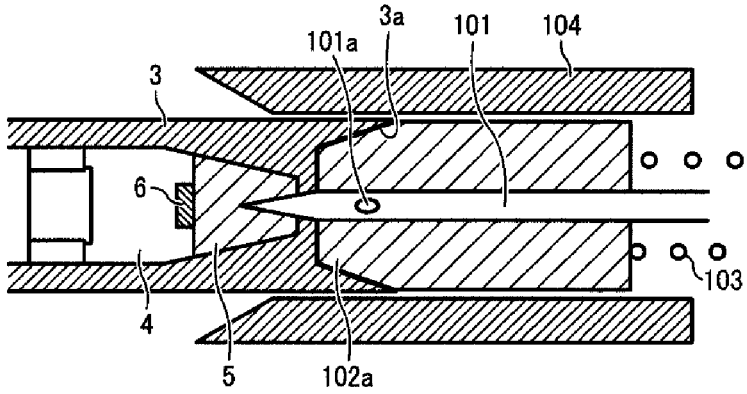
Figure 4C:
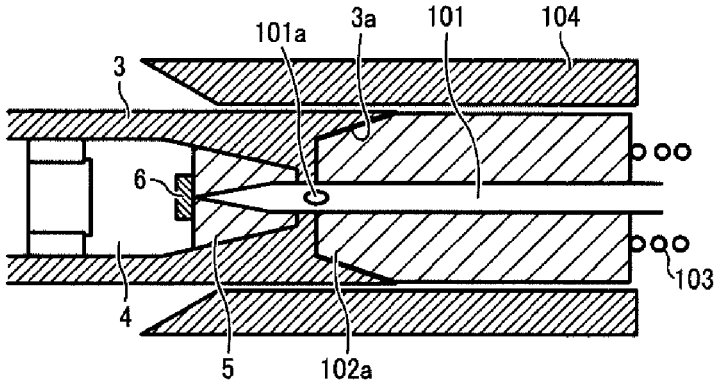

From this state, as the ink cartridge 1 is further inserted to the image forming apparatus, the hollow needle 101 is also inserted to the seal member 5 of the ink cartridge 1 as illustrated in FIG. 4B. Further, the front end of the hollow needle 101 contacts the hard member 6 as illustrated in FIG. 4C and then pushes the seal member 5 backward (i.e., toward the ink cartridge 1). Then, as illustrated in FIG. 5, the seal member 5 separates from the inner wall surface of the supply channel 4 to form a gap between the seal member 5 and the inner wall surface of the supply channel 4. Accordingly, the supply channel 4 is opened to secure an internal ink channel indicated by an arrow 8 illustrated in FIG. 5.

By contrast, when the ink cartridge 1 is detached from the image forming apparatus, the above-described operations are performed in the opposite order. For the detachment operation, the hollow needle 101 retreats relative to the ink cartridge 1 and the seal member 5 fits and seals the inner wall surface of the supply channel 4 again. Meanwhile, the protective member 102 of the image forming apparatus remains fitted to the recessed portion 3*a* of the supply port assembly 3 by a bias force of the spring 103 that is a bias member. Accordingly, when the hollow needle 101 is extracted from the supply port assembly 3, the hollow needle 101 is directly retracted into the protective member 102, thus preventing leakage of ink.

As described above, the ink cartridge according to the present illustrative embodiment includes the seal member made of an elastic material in the supply port assembly into which the liquid introducing member is inserted from the image forming apparatus. When inserted by the liquid introducing member, the seal member moves together with the liquid introducing member relative to the supply port assembly. In such a configuration, when the liquid introducing member in the image forming apparatus is extracted from the supply port assembly, sealing of the supply port assembly is secured, thus preventing leakage of liquid from the supply port assembly.

The image forming apparatus is provided with the bias member that biases the protective member forward (i.e., toward the ink cartridge (when the protective member is pushed inward (i.e., toward the image forming apparatus). In such a configuration, when the liquid container (ink cartridge) is installed to the image forming apparatus, the liquid introducing member is inserted to the supply port assembly with the protective member closely fitted to the front end portion of the supply port assembly of the liquid container by the bias force of the bias member. Alternatively, when the liquid container is detached from the image forming apparatus, the liquid introducing member is extracted from the supply port assembly and retracted into the protective member with the protective member closely fitted to the front end portion of the supply port assembly of the liquid container by the bias force of the bias member. Such a configuration allows insertion and extraction of the liquid introducing member with the liquid introducing member covered by the protective member, thus securely preventing leakage of liquid.

Figure 6:
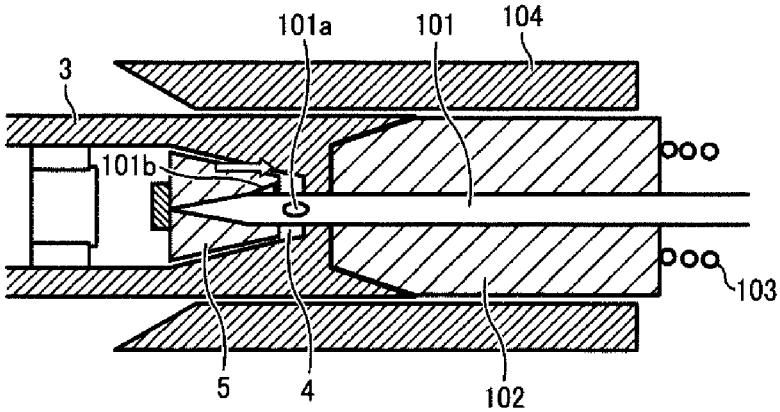
FIG. 6 is a cross-sectional view illustrating a coupling unit between an ink cartridge and an image forming apparatus according to a second illustrative embodiment.
Figure 7:
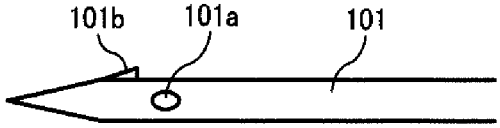
FIG. 7 is a partial view illustrating a hollow needle of the image forming apparatus.

Next, a second illustrative embodiment is described with reference to FIGS. 6 and 7. FIG. 6 is a cross-sectional view illustrating a coupling unit between the ink cartridge 1 and the image forming apparatus in the present illustrative embodiment. FIG. 7 is a schematic view illustrating a portion of a hollow needle 101 provided in the image forming apparatus according to the present illustrative embodiment.

On an outer surface of a front end portion of the hollow needle 101 is mounted a protrusion 101*b* to increase the resistance against the hollow needle 101 when the hollow needle 101 is extracted from the seal member 5 rather than when the hollow needle 101 is inserted to the seal member 5. In such a configuration, when the hollow needle 101 is extracted from the seal member 5, the seal member 5 closely fits the front end portion of a supply channel 4, allowing secure sealing.

Figure 8A:
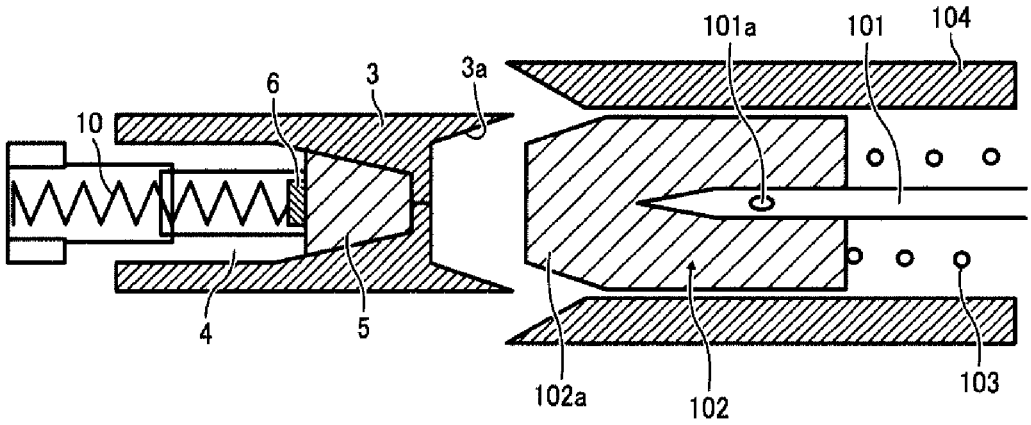
FIGS. 8A to 8C are cross-sectional views illustrating operations of a coupling unit between an ink cartridge and an image forming apparatus according to a third illustrative embodiment upon installation/detachment of the ink cartridge to/from the image forming apparatus.
Figure 8B:
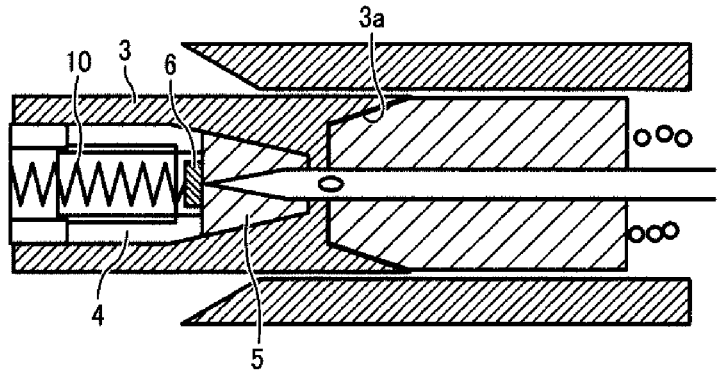
Figure 8C:
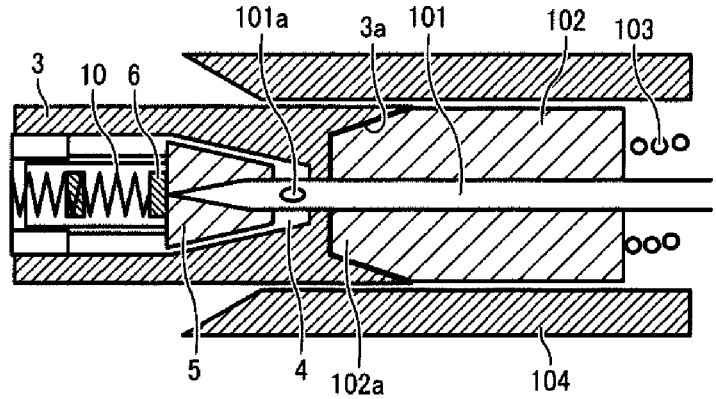

Next, a third illustrative embodiment is described with reference to FIG. 8. FIGS. 8A to 8C are cross-sectional views illustrating operations of a coupling unit between the ink cartridge 1 and the image forming apparatus when the ink cartridge 1 is installed to the image forming apparatus.

In the present illustrative embodiment, at the rear-end side of the seal member 5 is provided a resilient member 10 serving as a pressing member that biases the seal member 5 to close the supply channel 4. In such a configuration, when the hollow needle 101 is extracted from the seal member 5, the seal member 5 receives a bias force of the pressing member 10 and is pushed toward the front end portion of the supply channel 4, thus allowing the supply channel 4 to be more securely sealed with the seal member 5.

Figure 9:
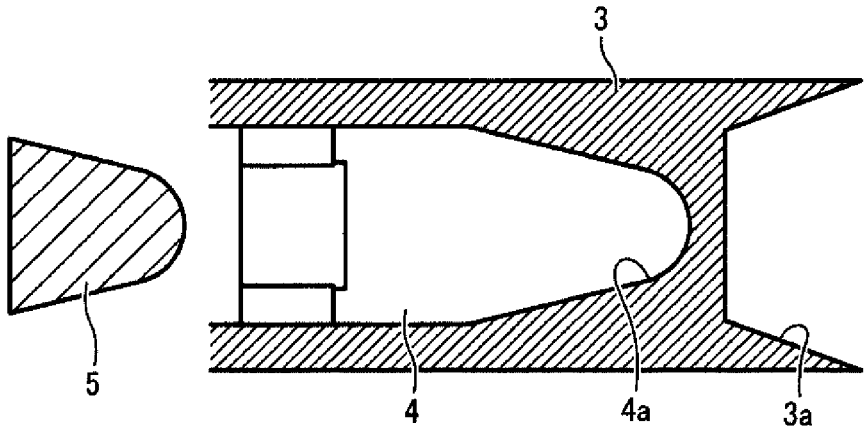
FIG. 9 is a cross-sectional view illustrating an example of a seal member of the ink cartridge.

In the above-described illustrative embodiments, the front end portion of the seal member 5 of the ink cartridge 1 is formed in conical trapezoidal shape to have a linearly tapered face. However, it is to be noted that the shape of the front end portion is not limited to the above-described shape and may have, e.g., a curved tapered face (bell shape) illustrated in FIG. 9, a stepwise tapered face, or any other suitable face.

Figure 10:
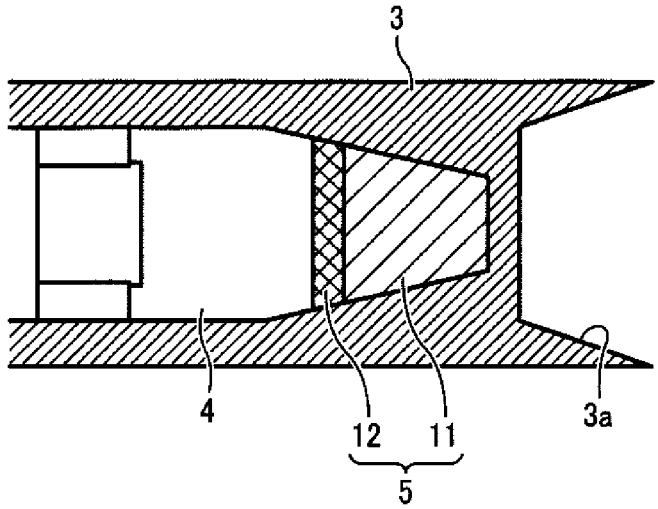
FIG. 10 is a cross-sectional view illustrating another example of the seal member of the ink cartridge.

Further, in the above-described illustrative embodiments, the hard member 6 is provided at the rear end face of the seal member 5 of the ink cartridge 1 to prevent the hollow needle 101 from piercing through the seal member 5. However, it is to be noted that, as illustrated in FIG. 10, the front side of the seal member 5 may be a low-hardness portion 11 and the rear end side of the seal member 5 may be a high-hardness portion 12. If the seal member 5 is completely pierced through by the hollow needle 101, residual ink might leak from the used ink cartridge 1 during transportation or shipping. Hence, the above-described illustrative embodiments employ the configuration that prevents the hollow needle 101 from piercing through the seal member 5. Further, the seal member 5 (elastic member) is biased in the ink cartridge 1 used, preventing leakage of residual ink.

Figure 11:
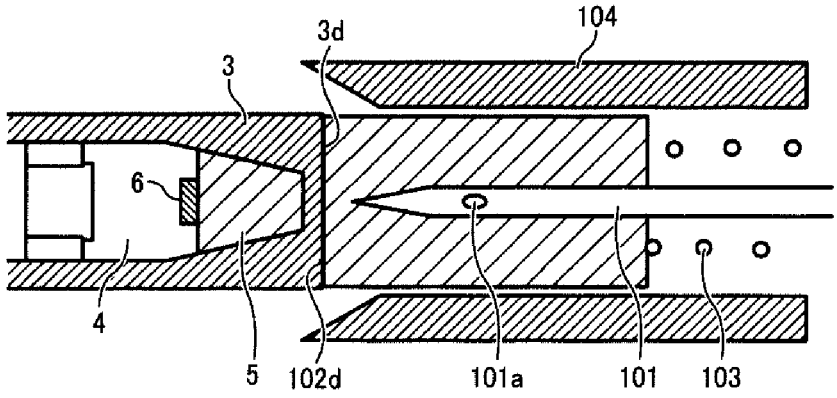
FIG. 11 is a cross-sectional view illustrating a coupling unit between an ink cartridge and an image forming apparatus according to a fourth illustrative embodiment.

Next, the fourth illustrative embodiment is described with reference to FIG. 11. FIG. 11 is a cross-sectional view illustrating a coupling unit between the ink cartridge 1 and the image forming apparatus in the present illustrative embodiment.

In FIG. 11, both the front end face 3*d* of the supply port assembly 3 of the ink cartridge 1 and the front end face 102*d* of the protective member 102 are formed flat so as to closely fit to each other. Such a configuration allows insertion/extraction of the hollow needle 101 to/from the seal member 5 of the supply port assembly 3 with the front end face 3*d* of the supply port assembly 3 and the front end face 102*d* of the protective member 102 closely fitting to each other, thus preventing leakage of ink.

Figure 12:
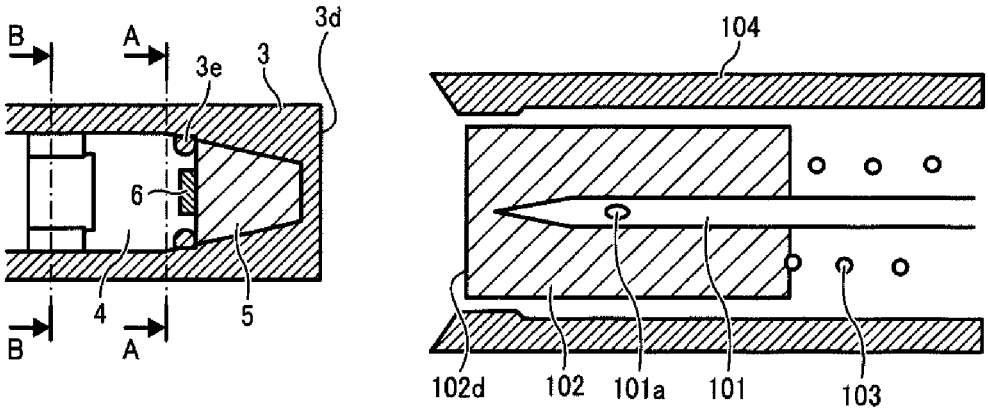
FIG. 12 is a cross-sectional view illustrating a coupling unit between an ink cartridge and an image forming apparatus according to a fifth illustrative embodiment.
Figure 13:
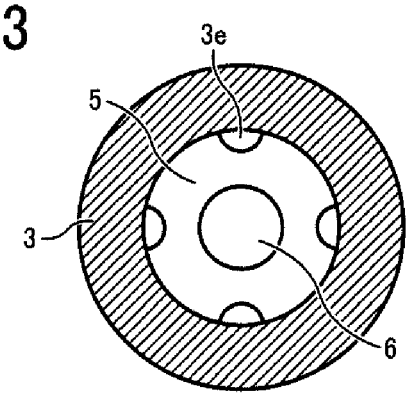
FIG. 13 is a cross-sectional side view illustrating a supply port assembly cut along a line A-A illustrated in FIG. 12.
Figure 14:
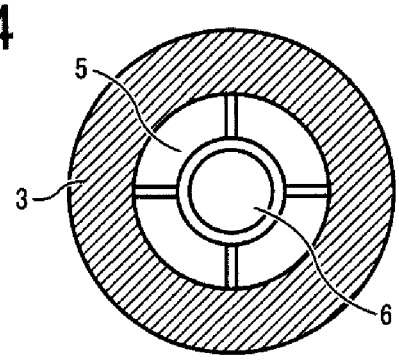
FIG. 14 is a cross-sectional side view cut illustrating the supply port assembly along a line B-B illustrated in FIG. 12.

Next, the fifth illustrative embodiment is described with reference to FIGS. 12 to 14. FIG. 12 is a cross-sectional view illustrating a coupling unit between the ink cartridge 1 and the image forming apparatus in the present illustrative embodiment. FIG. 13 is a cross-sectional side view cut along an A-A line illustrated in FIG. 12. FIG. 14 is a cross-sectional side view cut along a B-B line illustrated in FIG. 12.

In the present illustrative embodiment, a projection(s) 3*e* is(are) provided inside (at the inner surface of) the supply port assembly 3 behind the seal member 5 to hold (prevent accidental detachment of) the seal member 5. The number of the projection(s) may be any suitable number, and the height of the projection(s) is set to a height so that the seal member 5 smoothly moves and is firmly held by the projection(s) on installation/detachment of the ink cartridge 1 to/from the image forming apparatus.

Figure 15A:
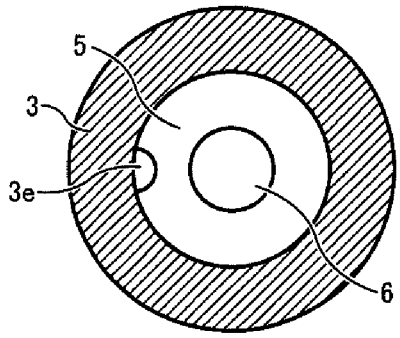
FIGS. 15A to 15C are cross-sectional side views illustrating examples of a projection(s) of the supply port assembly.
Figure 15B:
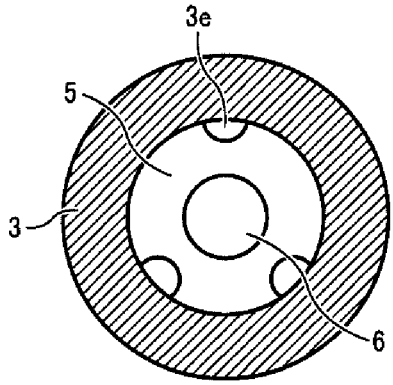
Figure 15C:
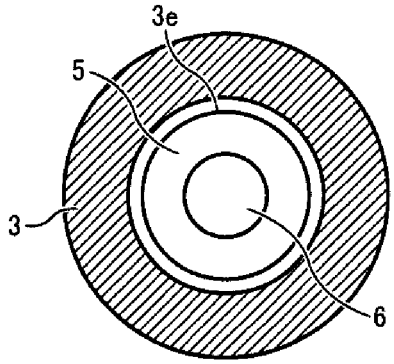

In the present illustrative embodiment, as illustrated in FIG. 13, four projections 3*e* are disposed at opposing positions with respect to the center of the liquid introducing member (the hollow needle 101). However, it is to be noted that, as illustrated in FIG. 15A, one projection 3*e* may be disposed on the inner face of the supply port assembly 3, or as illustrated in FIG. 15B, three projections 3*e* may be evenly spaced on the inner face of the supply port assembly 3. Alternatively, as illustrated in FIG. 15C, the projection 3 may be formed around the inner face of the supply port assembly 3.

Next, operations of the coupling portion upon installation/detachment of the ink cartridge 1 to/from the image forming apparatus are described with reference to FIGS. 16A to 16D and 17.

Figure 16A:
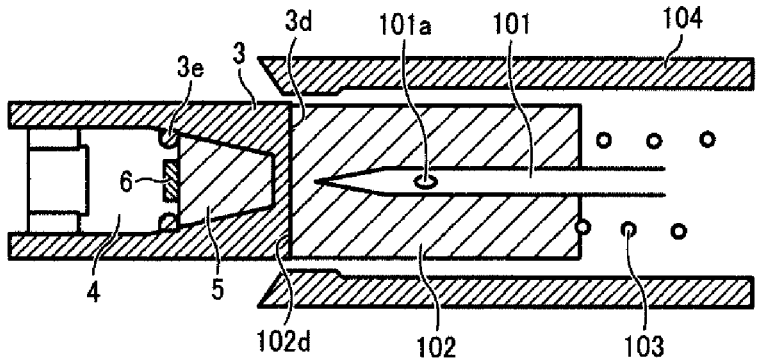
FIGS. 16A to 16D are cross-sectional views illustrating operations of the coupling unit according to the fifth illustrative embodiment upon installation/detachment of the ink cartridge to/from the image forming apparatus.

By inserting the ink cartridge 1 to the cartridge mount portion of the image forming apparatus, as illustrated in FIG. 16A, the flat face of the front end portion (front end face 3*d*) of the supply port assembly 3 of the ink cartridge 1 closely fits to the flat face of the front end portion (front end face 102*d*) of the protective member 102 of the image forming apparatus. At this state, the seal member 5 in the supply port assembly 3 of the ink cartridge 1 remains closely fitted to the inner wall surface of the supply channel 4, and the supply port assembly 3 is sealed from both the inside and outside thereof.

Figure 16B:
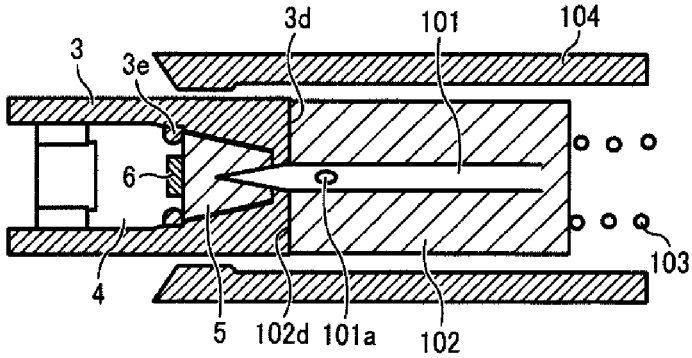
Figure 16C:
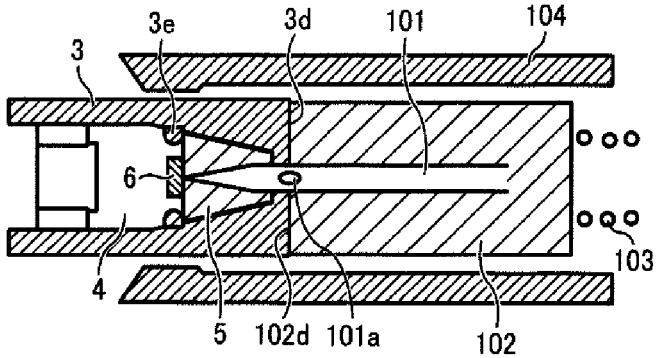
Figure 16D:
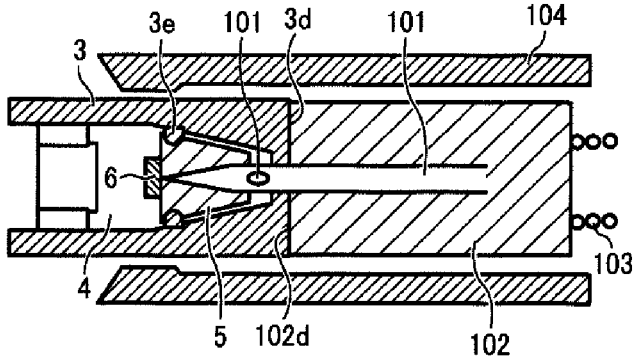
Figure 17:
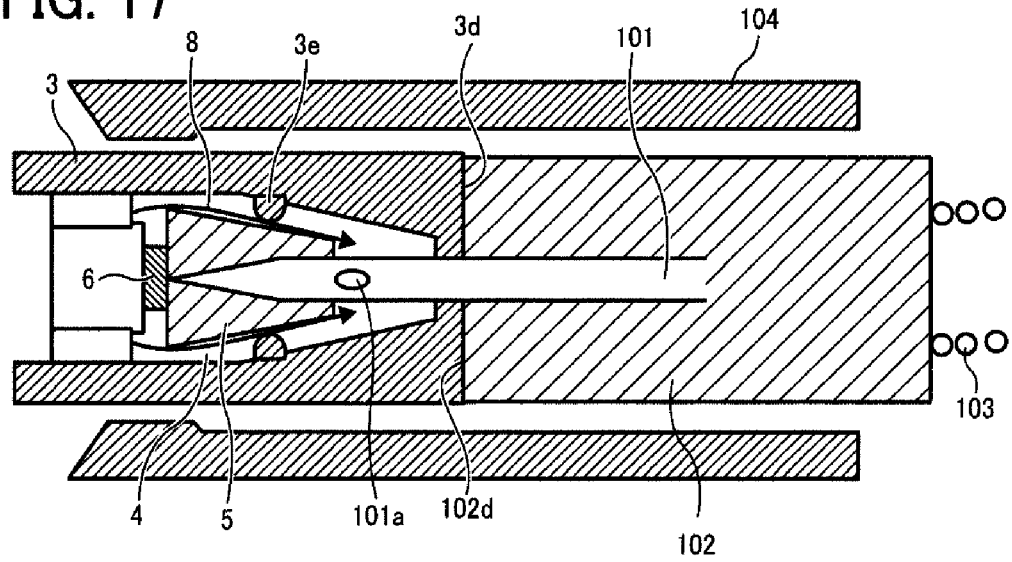
FIG. 17 is a cross-sectional view illustrating a state of the coupling unit when the ink cartridge is mounted in the image forming apparatus.

From the above-mentioned state, when the ink cartridge 1 is further inserted toward the image forming apparatus, as illustrated in FIG. 16B, the hollow needle 101 is inserted into the seal member 5 of the ink cartridge 1, and as illustrated in FIG. 16C, the front end of the hollow needle 101 contacts the hard member 6 and then pushes the seal member 5 rearward (i.e., toward the ink cartridge 1). Then, as illustrated in FIG. 16D, the seal member 5, while elastically deforming, moves over the projections 3*e* to the rearward of the projections 3*e*. As a result, the seal member 5 separates from the inner wall surface of the supply channel 4, forming a gap between them. Accordingly, the supply channel 4 is opened to secure an internal ink channel indicated by an arrow 8 illustrated in FIG. 17, thus allowing ink to be supplied from the ink pack 2 of the ink cartridge 1 to the image forming apparatus through the hollow needle hole 101*a* of the hollow needle 101.

By contrast, when the ink cartridge 1 is detached from the image forming apparatus, the above-described operations are performed in the opposite order. For the detachment operation, when the hollow needle 101 retreats relative to the ink cartridge 1, the seal member 5, while elastically deforming, moves over the projections 3*e* to the front end portion of the supply port assembly 3. Accordingly, the seal member 5 closely fits the inner wall surface of the supply channel 4 and the rear end portion of the seal member 5 is held with the projections 3*e*.

The protective member 102 of the image forming apparatus is kept fitting the supply port assembly 3 by the bias force of the spring 103. Accordingly, when the hollow needle 101 is extracted from the supply port assembly 3, the hollow needle 101 is directly retracted into the protective member 102, thereby preventing leakage of ink.

Thus, the ink cartridge according to the present illustrative embodiment includes the seal member made of an elastic material at the supply port assembly into which the liquid introducing member of the image forming apparatus is inserted. When inserted by the liquid introducing member, the seal member moves together with the liquid introducing member relative to the supply port assembly. In such a configuration, when the liquid introducing member of the image forming apparatus is extracted from the supply port assembly, the supply port assembly is securely sealed, thus preventing leakage of liquid from the supply port assembly.

When the ink cartridge 1 is installed to and then detached from the image forming apparatus, in the interior of the ink cartridge 1, the supply channel 4 of the supply port assembly 3 is sealed with the seal member 5 and the seal member 5 is securely held with the projections 3*e*. Such a configuration prevents the sealing of the supply channel 4 with the seal member 5 from loosening by vibration during transportation of used cartridges and so forth, thus preventing leakage of ink.

At the image forming apparatus is provided the bias member that biases the protective member forward when the protective member is pushed inward. In such a configuration, when the liquid container (ink cartridge) is installed to the image forming apparatus, the liquid introducing member is inserted into the supply port assembly with the protective member closely fitted to the front end portion of the supply port assembly of the liquid container by the bias force of the bias member. Alternatively, when the liquid container is detached from the image forming apparatus, the liquid introducing member is extracted from the supply port assembly and retracted into the protective member with the protective member closely fitted to the front end portion of the supply port assembly of the liquid container by the bias force of the bias member. Such a configuration allows insertion and extraction of the liquid introducing member with the liquid introducing member covered by the protective member, thus securely preventing leakage of liquid.

Figure 18A:
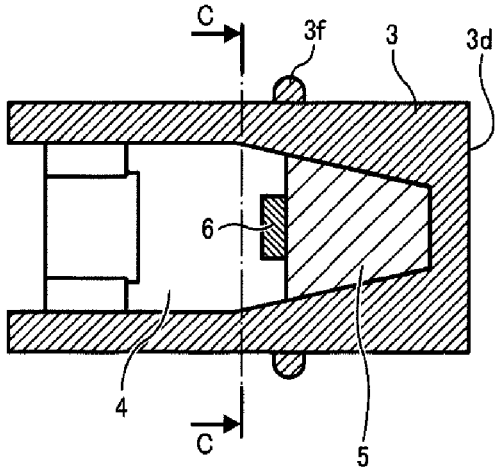
FIG. 18A is a cross-sectional view illustrating a supply port assembly of an ink cartridge according to a sixth illustrative embodiment.
Figure 18B:
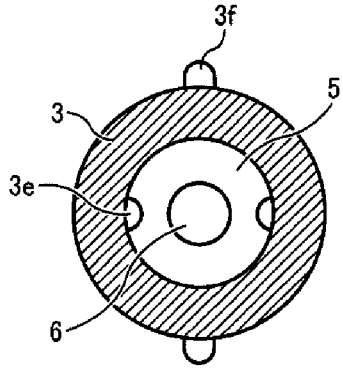
FIG. 18B is a cross-sectional view illustrating the supply port assembly cut along a line C-C illustrated in FIG. 18A.
Figure 19A:
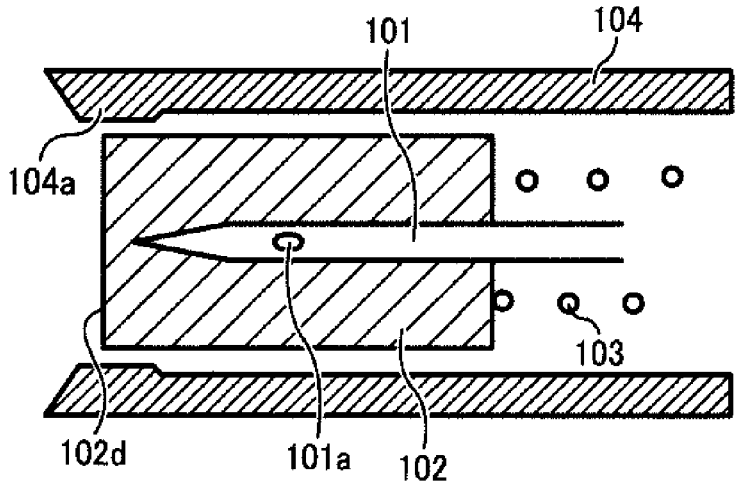
FIG. 19A is a cross-sectional view illustrating a coupling portion of the image forming apparatus.
Figure 19B:
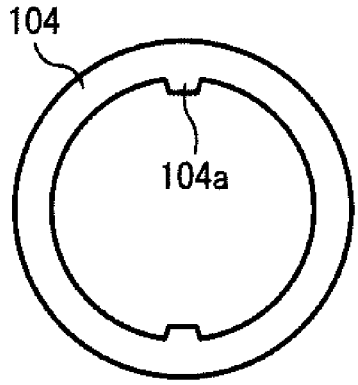
FIG. 19B is a cross-sectional side view illustrating the coupling portion illustrated in FIG. 19A.

Next, a sixth illustrative embodiment is described with reference to FIGS. 18A and 18B and 19A and 19B. FIG. 18A is a cross sectional view illustrating a supply port assembly in the present illustrative embodiment. FIG. 18B is a cross sectional view illustrating the supply port assembly cut along a C-C line illustrated in FIG. 18A. FIG. 19A is a cross-sectional view illustrating a coupling portion of the image forming apparatus in the present illustrative embodiment. FIG. 19B is a cross-sectional side view illustrating the coupling portion illustrated in FIG. 19A.

In the present illustrative embodiment, projections 3*e* are disposed inside (at the inner surface of) the supply port assembly 3 at opposite positions with respect to the center of the hollow needle 101 and projections 3*f* are disposed on the outer surface of (outside) the supply port assembly 3 at opposite positions with respect to the center of the hollow needle 101. As illustrated in FIG. 18B, the projections 3*e* and the projections 3*f* may be disposed at different positions on the same cross section with the phases shifted by 90 degrees with each other.

In the image forming apparatus, projections 104*a* that engage the projections 3*f* on the outer surface are provided at opposite positions on the inner surface of the hollow guide member 104 of cylindrical shape.

Figure 20A:
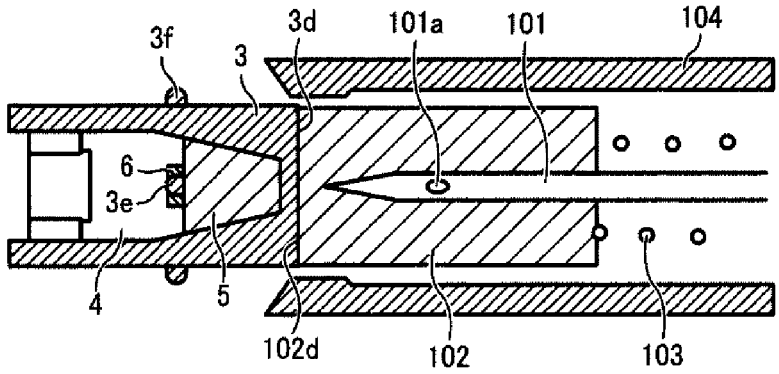
FIGS. 20A to 20C are cross-sectional views illustrating operations of a coupling unit according to the sixth illustrative embodiment upon installation of the ink cartridge to the image forming apparatus.
Figure 20B:
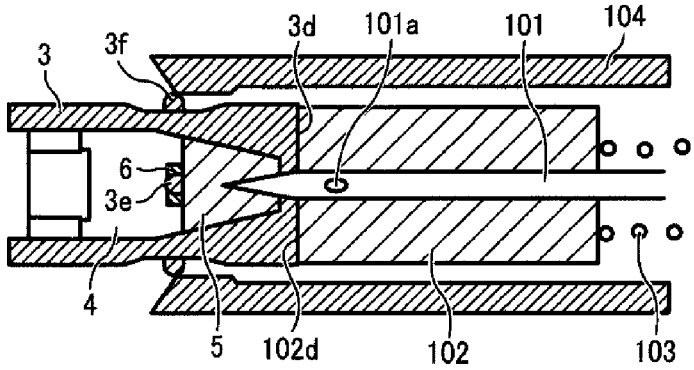
Figure 20C:
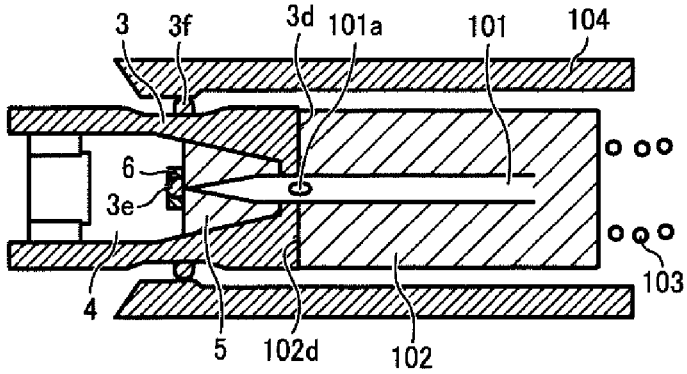
Figure 21A:
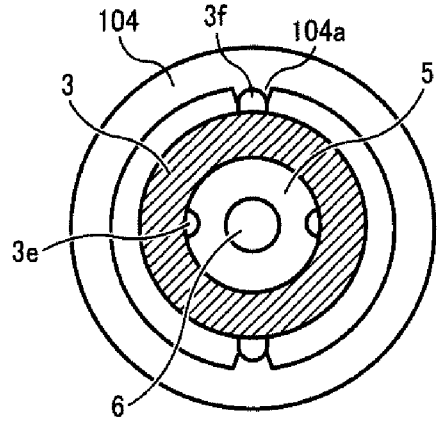
FIGS. 21A to 21C are cross-sectional side views corresponding to FIGS. 20A to 20C.
Figure 21B:
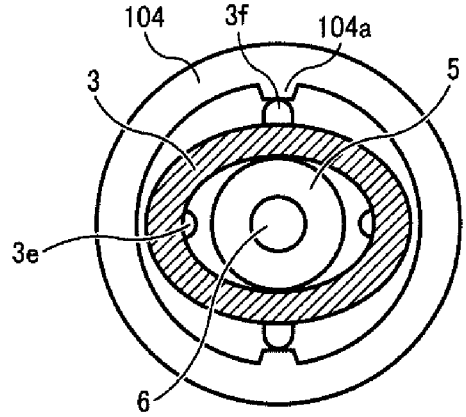
Figure 21C:
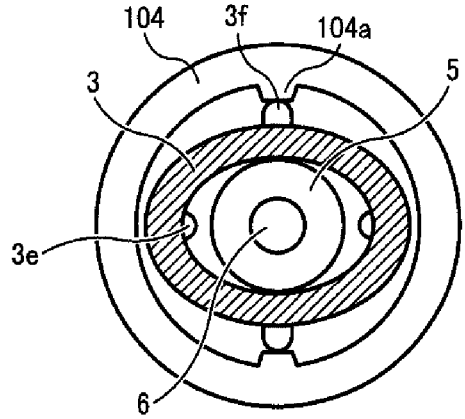
Figure 22A:
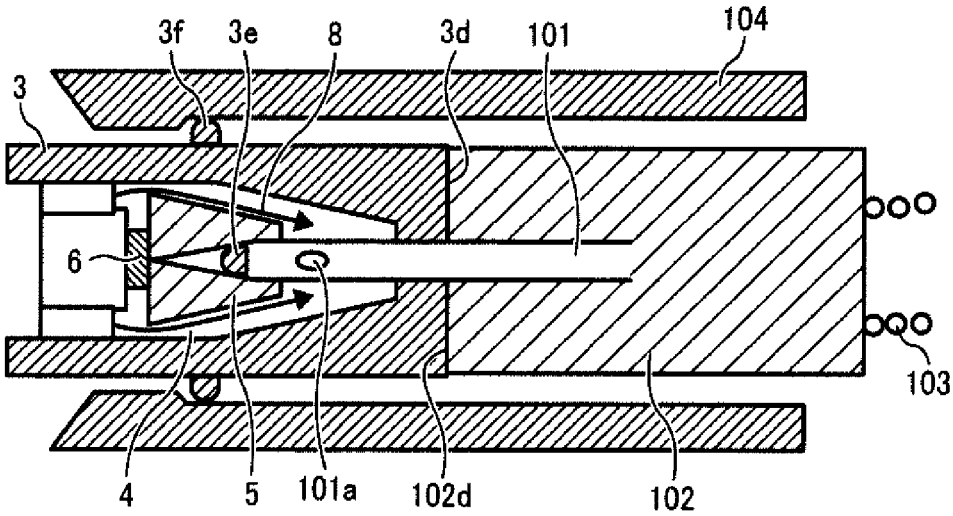
FIG. 22A is a cross-sectional view illustrating a state of the coupling unit when ink is supplied from the ink cartridge to the image forming apparatus.
Figure 22B:
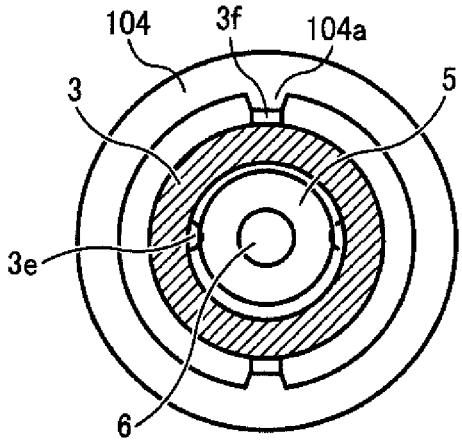
FIG. 22B is a cross-sectional side view illustrating a cross-sectional side view illustrating the coupling unit illustrated in FIG. 22A.

Next, installing operation of the ink cartridge to the image forming apparatus in the present illustrative embodiment is described with reference to FIGS. 20A to 20C, 21A to 21C, and 22A and 22B. FIGS. 20A to 20C are cross-sectional views illustrating a coupling unit according to the sixth illustrative embodiment. FIGS. 21A to 21C are cross-sectional side views illustrating the coupling unit illustrated in FIGS. 20A to 20C. FIG. 22A is a cross-sectional view illustrating a state of the coupling unit when ink is supplied from the ink cartridge to the image forming apparatus. FIG. 22B is a cross-sectional side view illustrating the coupling unit illustrated in FIG. 22A.

By inserting the ink cartridge 1 into a cartridge mount portion of the image forming apparatus, as illustrated in FIGS. 20A and 21A, the flat face (front end face) 3*d* of the front end portion of the supply port assembly 3 of the ink cartridge 1 closely fits the flat face (front end face) 102*d* of the protective member 102 provided in the image forming apparatus. At this state, the seal member 5 in the supply port assembly 3 of the ink cartridge 1 remains closely fitted to the inner wall surface of the supply channel 4, and the supply port assembly 3 is sealed from both the inside and outside thereof.

From this state, when the ink cartridge 1 is further inserted toward the image forming apparatus, the hollow needle 101 is also inserted into the seal member 5 of the ink cartridge 1 as illustrated in FIGS. 20B and 21B. The projections 3*f* on the outer surface of the supply port assembly 3 contact against the projections 104*a* on the inner surface of the cartridge mount portion 104. Then, as illustrated in FIG. 21B, the supply port assembly 3 of the ink cartridge 1 deforms in elliptic shape so as to extend the distance between the projections 3*e* on the inner surface of the supply port assembly 3. In such a case, the holding (latching) of the seal member 5 by the projections 3*e* may be completely released.

When the ink cartridge 1 is further inserted toward the image forming apparatus, as illustrated in FIGS. 20C and 21C, the front end of the hollow needle 101 contacts against the hard member 6 and then pushes the seal member 5 rearward. At this time, as the distance between the projections 3*e* is extended by elliptic deformation of the supply port assembly 3, the seal member 5 more smoothly passes the projections 3*e* than in the configuration of the illustrative embodiment illustrated in FIG. 12.

Further, as illustrated in FIGS. 22A and 22B, the seal member 5 separates from the inner wall surface of the supply channel 4 to form a gap between them, so that the supply channel 4 is opened to secure an internal ink channel indicated by an arrow 8 illustrated in FIG. 22A. Thus, ink is supplied from the ink pack 2 of the ink cartridge 1 to the image forming apparatus through the hollow needle hole 101*a* of the hollow needle 101.

Figure 23A:
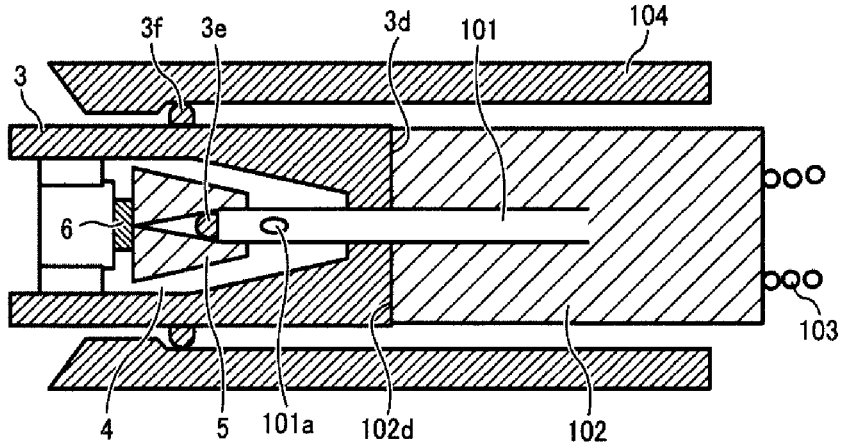
FIGS. 23A to 23C are cross-sectional views illustrating operations of the coupling unit according to the sixth illustrative embodiment upon detachment of the ink cartridge from the image forming apparatus.
Figure 23B:
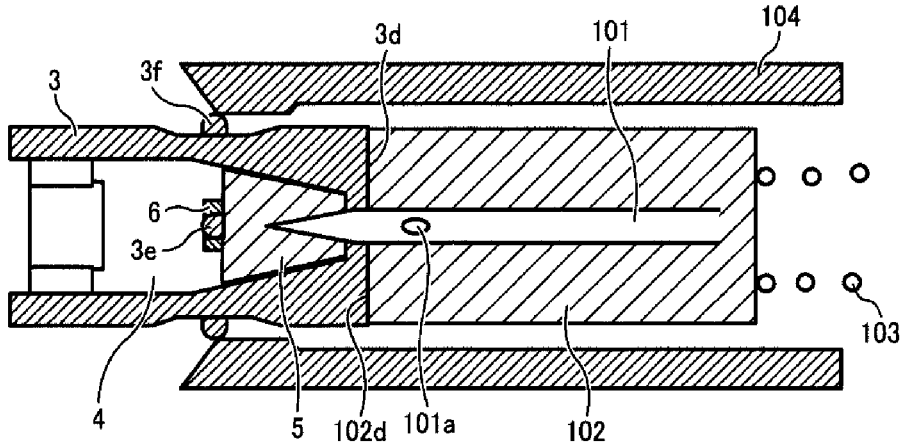
Figure 23C:
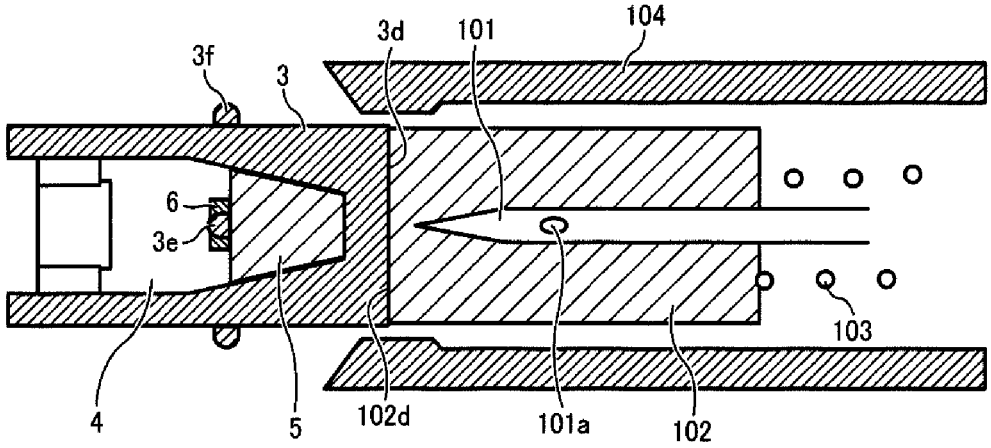
Figure 24A:
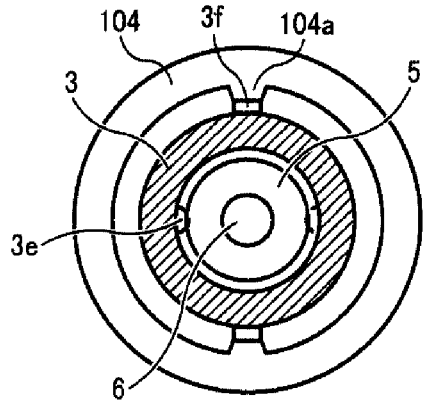
FIGS. 24A to 24C are cross-sectional side views corresponding to FIGS. 23A to 23C.
Figure 24B:
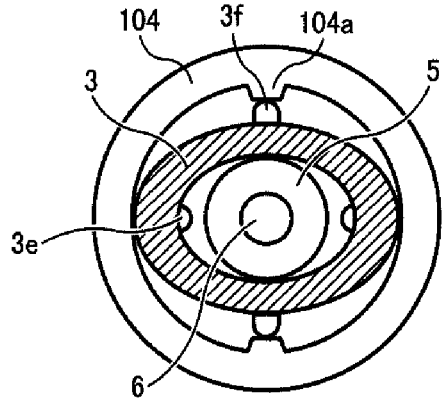
Figure 24C:
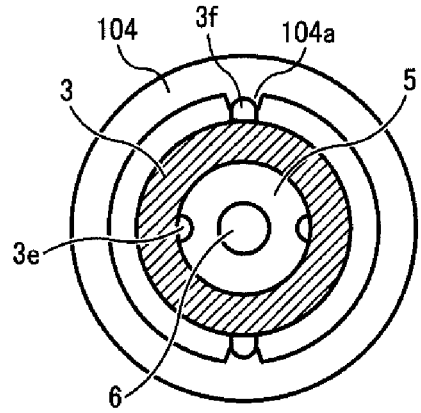

Next, detachment operation of the ink cartridge from the image forming apparatus in the present illustrative embodiment is described with reference to FIGS. 23A to 23C and 24A to 24C. FIGS. 23A to 23C are cross-sectional views illustrating the coupling unit according to the sixth illustrative embodiment. FIGS. 24A to 24C are cross-sectional side views illustrating the coupling portion illustrated in FIGS. 23A to 23C.

When the ink cartridge 1 is detached from the image forming apparatus, the above-described installing operations are performed in the opposite order. From the state illustrated in FIGS. 23A and 24A, the hollow needle 101 retreats relative to the ink cartridge 1. Then, as illustrated in FIGS. 23B and 24B, the projections 3*f* on the outer surface of the supply port assembly 3 contact against the projections 104*a* on the inner surface of the hollow guide member 104. As a result, the supply port assembly 3 of the ink cartridge 1 deforms in elliptic shape and at the same time the distance between the projections 3*e* on the inner surface of the supply port assembly 3 is extended.

Meanwhile, as illustrated in FIGS. 23C and 24C, with the protective member 102 of the image forming apparatus contacted with the supply port assembly 3 by a bias force of the spring 103, the hollow needle 101 is extracted from the supply port assembly 3 and directly retracted into the protective member 102. At this time, the supply channel 4 is closed by the seal member 5. The supply port assembly 3 deformed in elliptic shape restores the original shape and the seal member 5 is held by the projections 3*e*.

Next, a seventh illustrative embodiment is described with reference to FIG. 25. FIG. 25 is a cross-sectional view illustrating the coupling unit between the ink cartridge 1 and the image forming apparatus in the seventh illustrative embodiment.

In the present illustrative embodiment, a recessed portion 3*g* is formed at a front end portion of the supply port assembly 3 and the outer surface of the supply port assembly 3 tapers toward the front end thereof to form a cylindrical flange portion 3*h*. The projections 3*f* are provided on the outer surface of the cylindrical flange portion 3*h*. In the supply port assembly 3, when the cylindrical flange portion 3*h* deforms so as to approach the projections 3*f* to each other, the supply port assembly 3 deforms around a wall forming portion forming a wall 3*i* of the supply port assembly 3 so as to extend the distance between the internal projections 3*e*.

Meanwhile, the projections 104*a* that engage the projections 3*f* of the outer surface of the supply port assembly 3 are disposed at opposite positions on the inner surface of the hollow guide member 104 of cylindrical shape of the image forming apparatus. The projections 104*a* include a slope portion 104*a*1 inclined inward to deform the projection 3*f* toward the center of the supply port assembly 3, a horizontal portion 104*a*2 substantially horizontally extending from an end of the slope portion 104*a*1 rearward, and a second slope portion 104*a*3 inclined from the horizontal portion 104*a*2 outward.

Figure 25A:
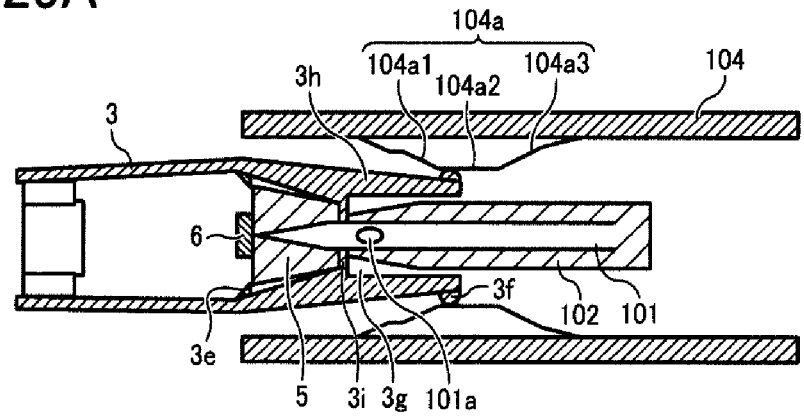
FIGS. 25A to 25C are cross-sectional views illustrating operations of a coupling unit between an ink cartridge and an image forming apparatus according to a seventh illustrative embodiment.

Thus, when the supply port assembly 3 of the ink cartridge 1 is inserted into the guide member 104 of the image forming apparatus as illustrated in FIG. 25A, the projections 3*f* of the supply port assembly 3 engage (contact) with the projections 104*a* of the guide member 104. As a result, the projections 3*f* are deformed inward and a rear portion of the supply port assembly 3 is deformed to extend the distance between the projections 3*e*, thus releasing the holding of the seal member 5 by the projections 3*e*.

Figure 25B:
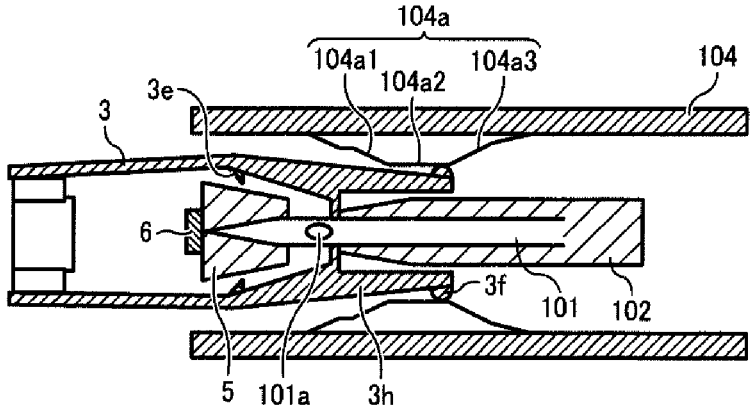
Figure 25C:
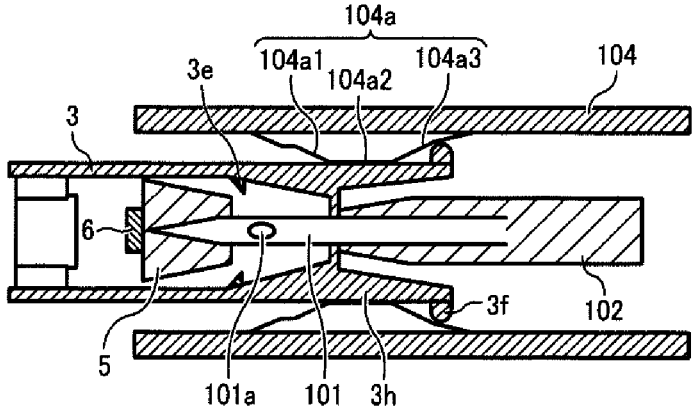

From the above-described state, when the ink cartridge 1 is further inserted toward the image forming apparatus, as with the above-described illustrative embodiment, the seal member 5 is moved rearward by the hollow needle 101 to open the supply channel 4 as illustrated in FIG. 25B. At this time, as the distance between the projections 3*e* is extended, the seal member 5 smoothly passes the projections 3*e* and moves rearward. When the ink cartridge 1 is further inserted, the projections 3*f* pass the horizontal portions 104*a*2 of the projections 104*a* as illustrated in FIG. 25C, and then the supply port assembly 3 restores the original (non-deformed) shape. At this state, ink is supplied from the ink cartridge 1.

Figure 26:
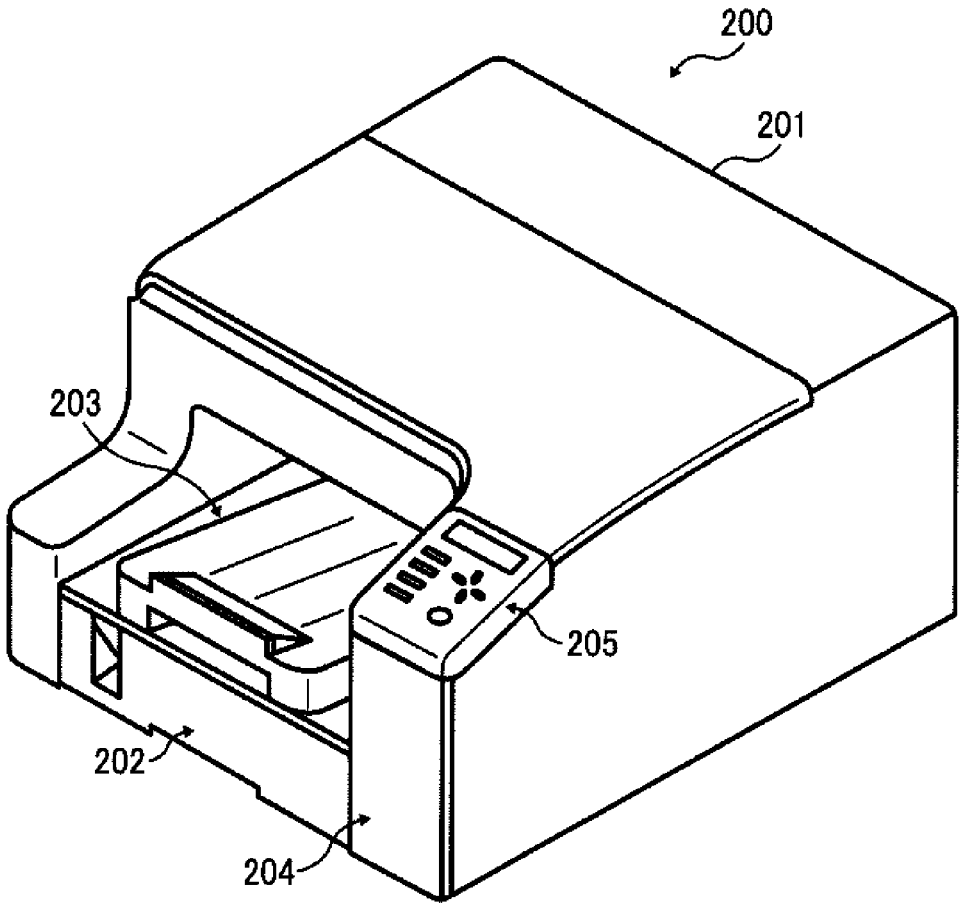
FIG. 26 is a perspective view illustrating an example of an image forming apparatus including a liquid container according to an illustrative embodiment.
Figure 27:
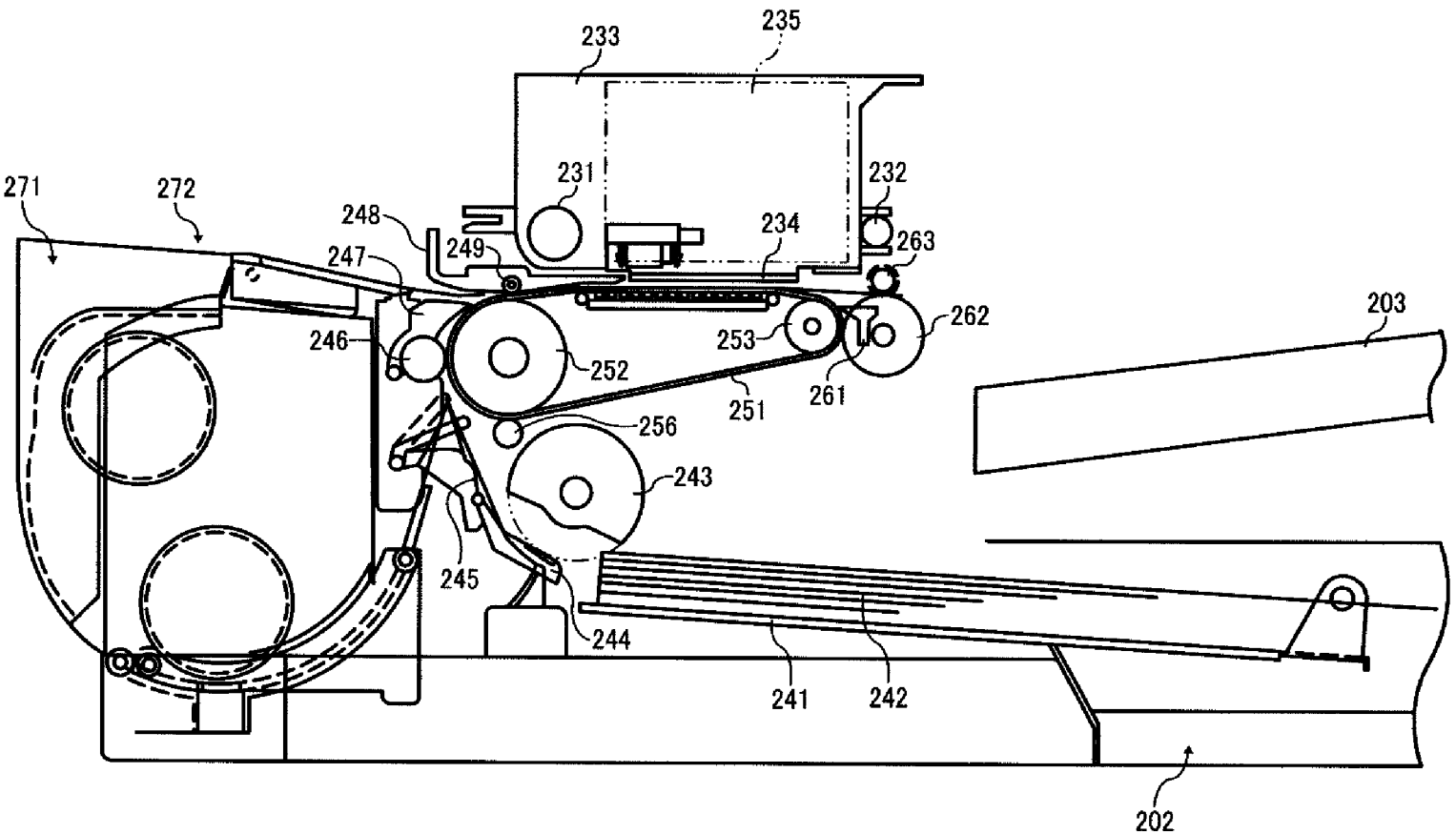
FIG. 27 is a schematic side view illustrating a mechanical section of the image forming apparatus.
Figure 28:
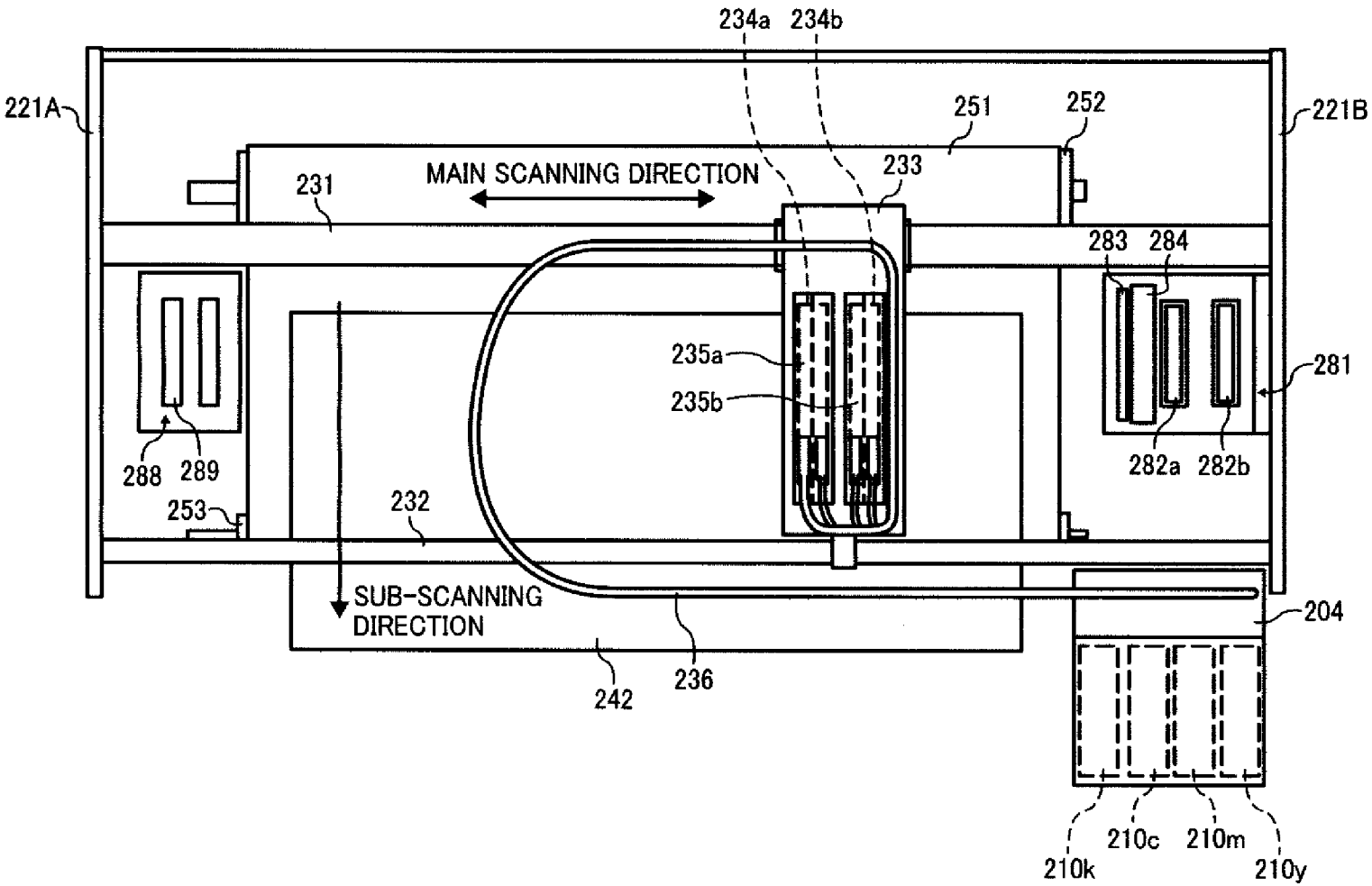
FIG. 28 is a schematic plan view illustrating the mechanical section of the image forming apparatus.

Next, an image forming apparatus employing a liquid container according to an illustrative embodiment is described with reference to FIGS. 26 to 28. FIG. 26 is an outer perspective view illustrating an image forming apparatus 200 in the present illustrative embodiment. FIG. 27 is a schematic side view illustrating a mechanical section of the image forming apparatus 200. FIG. 28 is a partial plan view illustrating the mechanical section.

In the present illustrative embodiment, the image forming apparatus 200 is described as a serial-type inkjet recording apparatus. The image forming apparatus 200 includes a housing 201, a sheet feed cassette 202, and a sheet output tray 203. The sheet feed cassette 202 is mounted in the housing 201 so as to be extractable to a sheet refill position and stores sheets to be fed to a print section of the image forming apparatus. The sheet output tray 203 receives a sheet outputted after image recording (formation). The sheet output tray 203 is pivotably mounted on the housing so as to open and close an upper portion of the sheet feed cassette 202, thus acting as a cover member of the sheet feed cassette 202. Further, at one end portion of the front side of the housing 201 is disposed a cartridge mount portion 204 in which an ink cartridge(s) serving as the liquid container according to the present illustrative embodiment is(are) mounted. At the top face of the cartridge mount portion 204 is mounted an operation-and-display unit 205 including operation buttons and a display. In the present illustrative embodiment, the configuration of the image forming apparatus according to any of the above-described illustrative embodiments is implemented in the cartridge mount portion 204.

In the image forming apparatus, both a main guide rod 231 and a sub guide rod 232 extend between side plates 201A and 202A to hold a carriage 233 slidable in a main scan direction "MSD" indicated by a double arrow illustrated in FIG. 28. The carriage 233 moves for scanning by a main scan motor, not illustrated, via a timing belt.

On the carriage 233 are mounted recording heads 234*a* and 234*b* (hereinafter, collectively referred to as "recording heads 234" unless colors are distinguished) that are the liquid ejection head according to the present illustrative embodiment to eject ink droplets of different colors, e.g., yellow (Y), cyan (C), magenta (M), and black (K). In the recording heads 234, a plurality of nozzle rows including nozzles is arranged in a sub-scan direction perpendicular to the main scan direction so as to eject ink droplets downward.

Each of the recording heads 234 may include two nozzle rows. For example, the recording head 234*a* may eject black ink droplets from one of the nozzle rows and cyan ink droplets from the other, and the recording head 234*b* may eject magenta ink droplets from one of the nozzle rows and yellow ink droplets from the other.

On the carriage 233 are mounted head tanks 235*a* and 235*b* (hereinafter collectively referred to as "head tanks 235" unless colors are distinguished) that supply color inks corresponding to the respective nozzle rows of the recording heads 234. Color inks are supplied from the ink cartridges 1 having, e.g., the configuration described in the first illustrative embodiment to the head tanks 235 via supply tubes 236.

The image forming apparatus 200 further includes a sheet feed section that feeds sheets 242 stacked on a sheet stack portion (platen) 241 of the sheet feed tray 202. The sheet feed section further includes a sheet feed roller 243 that separates the sheets 242 from the sheet stack portion 241 and feeds the sheets 242 sheet by sheet and a separation pad 244 that is disposed facing the sheet feed roller 243. The separation pad 244 is made of a material of a high friction coefficient and biased toward the sheet feed roller 243.

To feed the sheets 242 from the sheet feed section to a portion below the recording heads 234, the image forming apparatus 200 includes a first guide member 245 that guides the sheets 242, a counter roller 246, a conveyance guide member 247, a press member 248 including a front-end press roller 249, and a conveyance belt 251 that conveys the sheets 242 to a position facing the recording heads 234 with the sheets 242 electrostatically attracted thereon.

The conveyance belt 251 is an endless belt that is looped between a conveyance roller 252 and a tension roller 253 so as to circulate in a belt conveyance direction "BCD", that is, the sub-scan direction. A charge roller 256 is provided to charge the surface of the conveyance belt 251. The charge roller 256 is disposed to contact the surface of the conveyance belt 251 and rotate depending on the circulation of the conveyance belt 251. By rotating the conveyance roller 252 by a sub-scan motor, not illustrated, via a timing roller, the conveyance belt 251 circulates in the belt conveyance direction "BCD" illustrated in FIG. 28.

The image forming apparatus 200 further includes a sheet output section that outputs the sheet 242 on which an image is formed by the recording heads 234. The sheet output section includes a separation claw 261 that separates the sheet 242 from the conveyance belt 251, a first output roller 262, a second output roller 263, and the sheet output tray 203 disposed below the first output roller 262.

A duplex unit 271 is detachably mounted on a rear portion of the image forming apparatus 200. When the conveyance belt 251 rotates in the reverse direction to return the sheet 242, the duplex unit 271 receives the sheet 242 and turns the sheet 242 upside down to feed the sheet 242 between the counter roller 246 and the conveyance belt 251. At the top face of the duplex unit 271 is formed a manual-feed tray 272.

In FIG. 28, a maintenance-and-recovery unit 281 is disposed at a non-print area that is located on one end in the main-scan direction of the carriage 233. The maintenance-and-recovery unit 281 maintains and recovers nozzles of the recording heads 234. The maintenance-and-recovery unit 281 includes caps 282*a* and 282*b* (hereinafter collectively referred to as "caps 282" unless distinguished) that cover the nozzle faces of the recording heads 234, a wiping blade 283 that is a blade member to wipe the nozzle faces of the recording heads 234, and a first droplet receiver 284 that receives ink droplets ejected to expel increased-viscosity ink during maintenance ejection.

In FIG. 28, a second droplet receiver 288 is disposed at the non-print area on the other end in the main-scan direction of the carriage 233. The second droplet receiver 288 receives ink droplets that are ejected to expel an increased-viscosity ink in recording (image forming) operation and so forth. The second droplet receiver 288 has openings 289 arranged in parallel with the rows of nozzles of the recording heads 234.

In the image forming apparatus 200 having the above-described configuration, the sheet 242 is separated sheet by sheet from the sheet feed tray 202, fed in a substantially vertically upward direction, guided along the first guide member 245, and conveyed with sandwiched between the conveyance belt 251 and the counter roller 246. Further, the front tip of the sheet 242 is guided with a conveyance guide 237 and pressed with the front-end press roller 249 against the conveyance belt 251 so that the traveling direction of the sheet 242 is turned substantially 90 angle degrees. The sheet 242 is attracted on the charged conveyance belt 251 and conveyed in the sub scanning direction by circulation of the conveyance belt 251.

By driving the recording heads 234 in response to image signals while moving the carriage 233, ink droplets are ejected on the sheet 242 stopped below the recording heads 234 to form one band of a desired image. Then, the sheet 242 is fed by a certain distance to prepare for recording another band of the image. Receiving a signal indicating that the image has been recorded or the rear end of the sheet 242 has arrived at the recording area, the recording heads 234 finishes the recording operation and outputs the sheet 242 to the sheet output tray 203.

As described above, the liquid container (ink cartridge) according to the above-described illustrative embodiments is detachably mounted in the image forming apparatus, thus reducing or preventing ink leakage on installing/detaching the liquid container to/from the image forming apparatus.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. A liquid container detachably mountable in an image forming apparatus having a liquid introducing member, the liquid container comprising:

a storage unit disposed in the liquid container to store a liquid usable for image formation;

a supply port assembly mounted in the storage unit and having a supply channel therein, the supply port assembly into which the liquid introducing member of the image forming apparatus is inserted;

an elastic seal member disposed in the supply port assembly, the elastic seal member, when penetrated by the liquid introducing member, moving together with the liquid introducing member relative to the supply port assembly to open and close the supply channel; and a stopper mounted on a rear side of the elastic seal member configured to stop penetration of the liquid introducing member.

2. The liquid container according to claim 1, wherein the supply channel of the supply port assembly has a tapered face that tapers toward a front end portion of the supply port assembly and the seal member has a tapered face that fits the tapered face of the supply channel.

3. The liquid container according to claim 1, further comprising a pressing member that presses the seal member toward a front end portion of the supply port assembly.

4. The liquid container according to claim 1, further comprising an internal projection disposed on an inner surface of the supply port assembly at a position behind a rear end face of the seal member, the internal projection being configured to hold the seal member.

5. The liquid container according to claim 1, further comprising a plurality of opposed internal projections disposed on an inner surface of the supply port assembly to hold the seal member and a plurality of opposed external projections disposed on an outer surface of the supply port assembly, the supply port assembly deformable to move the plurality of external projections toward each other and move the plurality of internal projections away from each other, wherein, in installation of the liquid container to the image forming apparatus, the plurality of external projections of the supply port assembly contactable against the image forming apparatus to press the supply port assembly to move the plurality of external projections of the supply port assembly toward each other and move the plurality of internal projections of the supply port assembly away from each other.

6. The liquid container according to claim 5, wherein the supply port assembly is cylindrical and the plurality of internal projections and the plurality of external projections are disposed on an identical cross-sectional portion of the supply port assembly.

7. An image forming apparatus, comprising:

a liquid introducing member having an inlet port in a front end portion thereof to introduce liquid from the inlet port;

a protective member movably mounted on the front end portion of the liquid introducing member to cover the inlet port of the liquid introducing member;

a bias member disposed at a rear side of the protective member, the bias member biasing the protective member toward a front side of the protective member; and a liquid container detachably mounted in the image forming apparatus, the liquid container comprising:

a storage unit disposed in the liquid container to store a liquid usable for image formation;

a supply port assembly mounted in the storage unit and having a supply channel therein, the supply port assembly into which the liquid introducing member of the image forming apparatus is inserted;

an elastic seal member disposed in the supply port assembly, the elastic seal member, when penetrated by the liquid introducing member, moving together with the liquid introducing member relative to the supply port assembly to open and close the supply channel; and a stopper mounted on a rear side of the elastic seal member to stop penetration of the liquid introducing member, the liquid introducing member inserted into the supply port assembly with the protective member fitted to a front end portion of the supply port assembly by the bias member in installation of the liquid container to the image forming apparatus, the liquid introducing member extracted from the supply port assembly and refracted into the protective member with the protective member fitted to the front end portion of the supply port assembly by the bias member in detachment of the liquid container from the image forming apparatus.

8. The image forming apparatus according to claim 7, wherein the supply channel of the supply port assembly has a tapered face that tapers toward the front end portion of the supply port assembly and the seal member has a tapered face that fits the tapered face of the supply channel.

9. The image forming apparatus according to claim 7, further comprising a pressing member that presses the seal member toward the front end portion of the supply port assembly.

10. The image forming apparatus according to claim 7, further comprising a protrusion mounted on the liquid introducing member.

11. The image forming apparatus according to claim 7, further comprising a plurality of opposed internal projections disposed on an inner surface of the supply port assembly to hold the seal member and a plurality of opposed external projections disposed on an outer surface of the supply port assembly, the supply port assembly deformable to move the plurality of external projections toward each other and move the plurality of internal projections away from each other, wherein, in installation of the liquid container to the image forming apparatus, the plurality of external projections of the supply port assembly contactable against the image forming apparatus to press the supply port assembly to move the plurality of external projections of the supply port assembly toward each other and move the plurality of internal projections of the supply port assembly away from each other.

12. The image forming apparatus according to claim 11, wherein the supply port assembly is cylindrical and the plurality of internal projections and the plurality of external projections are disposed on an identical cross-sectional portion of the supply port assembly.

13. An image forming apparatus, comprising:

a liquid introducing member having an inlet port in a front end portion thereof to introduce liquid from the inlet port;

a protective member movably mounted on the front end portion of the liquid introducing member to cover the inlet port of the liquid introducing member;

a bias member disposed at a rear side of the protective member, the bias member biasing the protective member toward a front side of the protective member; and a liquid container detachably mounted in the image forming apparatus, the liquid container comprising:

a storage unit disposed in the liquid container to store a liquid usable for image formation;

a supply port assembly mounted in the storage unit and having a supply channel therein, the supply port assembly into which the liquid introducing member of the image forming apparatus is inserted;

an elastic seal member disposed in the supply port assembly, the elastic seal member, when penetrated by the liquid introducing member, moving together with the liquid introducing member relative to the supply port assembly to open and close the supply channel; and an internal projection disposed on an inner surface of the supply port assembly to hold the seal member, the liquid introducing member inserted into the supply port assembly with the protective member fitted to a front end portion of the supply port assembly by the bias member in installation of the liquid container to the image forming apparatus, the liquid introducing member extracted from the supply port assembly and refracted into the protective member with the protective member fitted to the front end portion of the supply port assembly by the bias member in detachment of the liquid container from the image forming apparatus, wherein, in installation of the liquid container to the image forming apparatus, the seal member inserted by the liquid introducing member moves over the internal projection to open the supply channel.

14. The image forming apparatus according to claim 13, wherein, in detachment of the liquid container from the image forming apparatus, by extraction of the liquid introducing member from the supply port assembly, the seal member inserted by the liquid introducing member moves to a position closer to the image forming apparatus than the internal projection and fits the supply port assembly to close the supply channel.

* * * * *